US005399946A

United States Patent [19]

Son et al.

[11] Patent Number: 5,399,946

[45] Date of Patent: Mar. 21, 1995

[54] DYNAMIC FOCUSING ELECTRON GUN

[75] Inventors: Kwang-yun Son; Yong-seok Song, both of Kyungki-do; Il-tae Kim, Seoul, all of Rep. of Korea

[73] Assignee: Samsung Display Devices Co., Ltd., Kyungki-Do, Rep. of Korea

[21] Appl. No.: 141,024

[22] Filed: Oct. 26, 1993

[30] Foreign Application Priority Data

Dec. 17, 1992 [KR] Rep. of Korea ..... 92-24629 U

[51] Int. Cl.[6] ..... H01J 29/58

[52] U.S. Cl. ..... 315/382; 315/382.1

[58] Field of Search ..... 315/382, 382.1, 14, 315/15

[56] References Cited

U.S. PATENT DOCUMENTS

Re. 33,592 5/1991 Gerritsen et al. ..... 315/382
4,473,775 9/1984 Hosokoshi et al. .
4,731,563 3/1988 Bloom et al. .
4,771,216 9/1988 Blacker et al. .
4,814,670 3/1989 Suzuki et al. .
4,886,999 12/1989 Yamane et al. ..... 313/414
4,891,564 1/1990 Crowley ..... 315/382
4,945,284 7/1990 Shimoma et al. ..... 313/382
5,025,189 6/1991 Son .
5,038,073 8/1991 Son .
5,164,640 11/1992 Son et al. .

*Primary Examiner*—Theodore M. Blum
*Attorney, Agent, or Firm*—Leydig, Voit & Mayer

[57] ABSTRACT

In a dynamic focus electron gun, a horizontal dynamic focus voltage is varied according to those portions of a screen where the electron beam arrives and is applied so that the peak-to-peak amplitude of the horizontal dynamic focus voltage in one horizontal deflection period for the upper and lower portions of the screen is greater than that for the screen's center, thereby accomplishing uniform beam spots throughout the screen.

2 Claims, 6 Drawing Sheets

DYNAMIC FOCUSING ELECTRON GUN

BACKGROUND OF THE INVENTION

The present invention relates to a dynamic focusing electron gun for color cathode ray tubes (CRTs), and more particularly to a dynamic focusing electron gun which forms high-resolution beam spots throughout a screen.

The resolution of a color CRT depends upon the size and shape of electron beam spots formed on the screen. In order to acquire high-resolution images, the electron beam spots should be as small as possible and their shape should be distorted as little as possible. However, an ordinary color CRT employs a self convergence method in which three electron beams are directed toward a target on the rear surface of the screen through a final accelerating lens of the electron gun, and a deflection yoke which forms a pincushion-typed horizontal deflection magnetic field and a barrel-typed vertical deflection magnetic field as a device for deflecting the electron beams. In this structure, the electron beams directed toward the periphery of the screen are deflected at a relatively large angle, passing through the non-uniform vertical and horizontal deflection magnetic fields. Thus, the electron beams passing the non-uniform magnetic fields are horizontally underfocused and vertically overfocused, and the beam spots formed by the electron beams reaching the screen's periphery are elongated horizontally so that a quite large halo is formed around the spots. There:fore, the portion of the image formed in the periphery of the screen suffers a degree of deterioration in comparison with that formed at the screen's center.

To prevent the peripheral image from deteriorating as described above, a method has been proposed in which a dynamic electric field is used to dynamically control the focusing of the electron beam according to screen areas, so as to form uniform spots throughout the screen. The method is embodied by a so-called dynamic focus electron gun whose various modifications are disclosed in U.S. Pat. Nos. 4,814,670, 4,473,775, 4,771,216 and 4,731,563.

Referring to FIG. 1, an ordinary dynamic focus electron gun comprises a cathode 2, control electrode 3 and screen electrode 4 constituting a triode for forming an electron beam, a static focus electrode 5*a*, dynamic focus electrode 5*b* and final accelerating electrode 6 constituting a main lens system for forming a static focus lens and dynamic focus lens.

Control electrode 3 is held at a 0 V potential while a screen voltage of 200–1200 V is applied to screen electrode 4. Static focus voltage Vs and dynamic focus voltage Vd are applied to static focus electrode 5*a* and dynamic focus electrode 5*b*, respectively. An accelerating voltage Va of 20–35 Kv is applied to accelerating electrode 6. Generally, dynamic focus voltage Vd is a parabolic waveform in synchronization with a deflection signal applied to the deflection yoke. Its peak voltage is 600 to 800 volts higher than the static focus voltage. Static focus voltage Vs is within the range of 20–35% of accelerating voltage Va.

The waveform of the dynamic focus voltage applied to such a dynamic focus electron gun appears generally as that of FIG. 2. Specifically, static focus voltage Vs applied to static focus electrode 5*a* is maintained at a predetermined potential. Then, parabolic dynamic focus voltage Vd applied to dynamic focus electrode 5*b* is varied according to the portions of the screen where the electron beam is to land, and is repeated for every horizontal deflection period (1 H) .

The minimum voltage of each parabolic waveform of one horizontal deflection period may be above, equal to or below the static focus voltage, and is relatively high when the electron beam lands at the extremities of any scanning line compared with when the beam lands at the center thereof. This difference in the minimum voltage is regularly varied by one vertical period (1 V) by frames.

The amplitude I for every horizontal deflection period of the parabolic dynamic voltage is the same throughout the screen, without regard to the landing areas of the electron beam. The maximum and minimum of the dynamic focus voltage is varied by one vertical period. One horizontal scanning line is formed for one horizontal deflection period and a plurality of the horizontal scanning lines are formed for one vertical period, so as to form one frame of image data.

In the graph of FIG. 2, upper and lower trend lines V1 and V2 constituted by the continuum of the parabolic waveform peaks (positive and negative, respectively) show the variation of the peak dynamic focus voltage with respect to the electron beam landing along any vertical line of the screen. (Here, the trend-line peaks occur at the extremities of the vertical lines.) This can be regarded as an assumed virtual vertical dynamic focus voltage. With reference to this, it is noted that the difference of the vertical and horizontal dynamic focus voltages to the static focus voltage is varied in respect to both directions (vertical and horizontal) of the screen. However, the peak-to-peak amplitude of Vd for one horizontal deflection period 1 H in the center of the screen is substantially equal to that in the upper or lower portions thereof. The vertical dynamic focus voltage is applied in a form in which, during the vertical deflection period, the variation rate for the left and right sides of the screen are the same as that for the screen's center. Therefore, the variation rates of upper and lower trend lines V1 and V2, showing the variation of vertical dynamic focus voltage Vd, are equal.

FIGS. 3 and 4 illustrate the waveforms of another conventional dynamic focus voltage.

First, referring to FIG. 3, when the electron beam lands on the center of the screen, the minimum of dynamic focus voltage Vd is lower than static focus voltage Vs, and when the electron beam lands on the upper and lower portions of the screen, the minimum of the dynamic focus voltage is relatively high.

Referring to FIG. 4, when the electron beam lands on the center of the screen, the minimum of dynamic focus voltage Vd is substantially equal to static focus voltage Vs. When the electron beam lands on the upper and lower portions of the screen, the minimum of the dynamic focus voltage is relatively high.

The amplitude of the dynamic focus voltage applied to the conventional dynamic focus electron gun stays constant regardless of the electron beam landing areas of the screen. However, since the distance from the electron beam projecting point (from the electron gun) to the screen varies according to landing position (the screen is aspherical) and since the electron beam is severely distorted due to the deflection yoke, uniform beam spots cannot be obtained throughout the screen. Given the structural limitations of CRTs, the above conventional method for applying voltages cannot realize a good-quality picture.

As shown in FIG. 5, when the focus of the electron beam accommodates the left and right peripheries of a screen 100, that is, at the extremities of a horizontal scanning line 110, the core of the beam spot at the center of scanning line 110 is enlarged, which thus greatly deteriorates the quality of the image formed on the center of the screen. Further, as shown in FIG. 6, when the electron beam is focused along the vertical line passing through the center of the screen, that is, accommodating the center of scanning line 110, the beam spots formed at the extremities of horizontal scanning line 110 exhibit large halos that diminish the quality of the picture.

SUMMARY OF THE INVENTION

Therefore, it is an object of the present invention to provide a dynamic focus electron gun which uniformly focuses an electron beam throughout a screen so as to obtain a good-quality picture throughout the whole screen.

To accomplish the object of the present invention, there is provided a dynamic focus electron gun comprising a cathode, control electrode and screen electrode which generate an electron beam, a static focus electrode to which a static focus voltage is applied to form a main lens for accelerating and converging the electron beam, a dynamic focus electrode to which a dynamic focus voltage is applied, and a final accelerating electrode to which a highest accelerating anode voltage is applied, wherein the dynamic focus voltage is varied according to portions of a screen where the electron beam arrives, and is applied so that the amplitude when the electron beam scans the upper and lower portions of the screen is greater than that when the electron beam scans the center of the screen.

BRIEF DESCRIPTION OF THE DRAWINGS

The above object and other advantages of the present invention will become more apparent by describing in detail a preferred embodiment thereof with reference to the attached drawings in which.

DETAILED DESCRIPTION OF THE INVENTION

Figure 1:
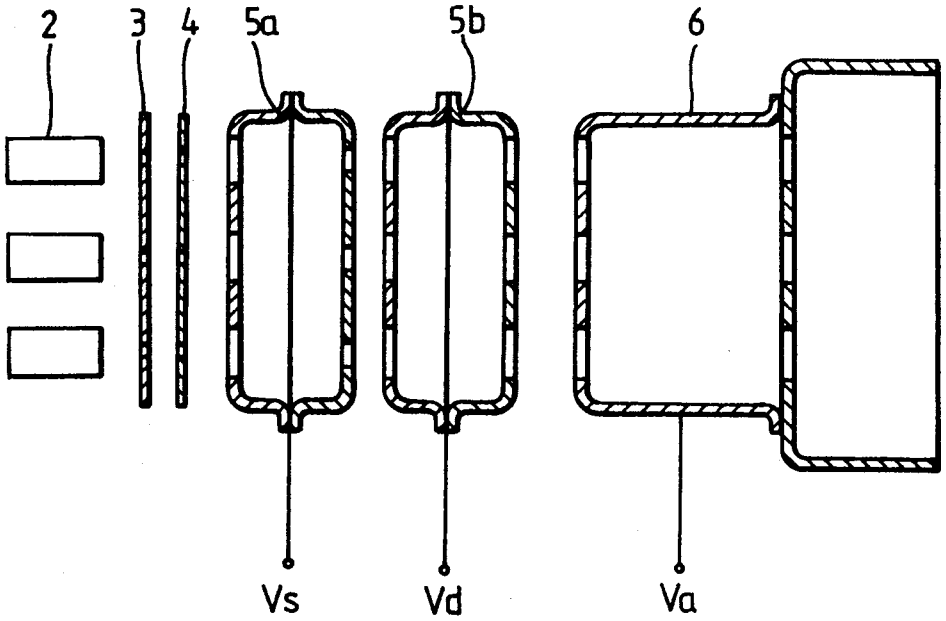
FIG.1(PRIOR ART)
FIG. 1 is a schematic cross-sectional view of a general dynamic focus electron gun.
Figure 2:
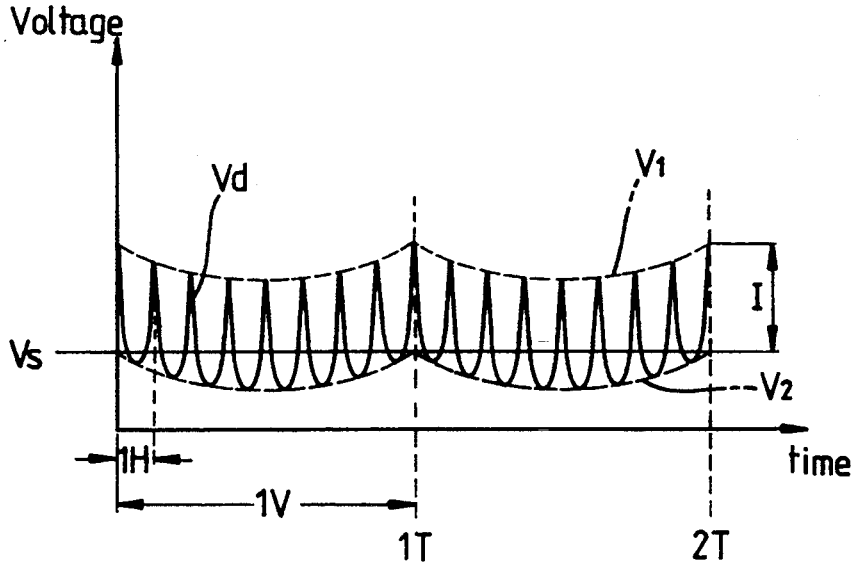
FIG.2(PRIOR ART)
FIG. 2 is a waveform diagram of a dynamic focus voltage applied to a conventional focus electron gun.
Figure 3:
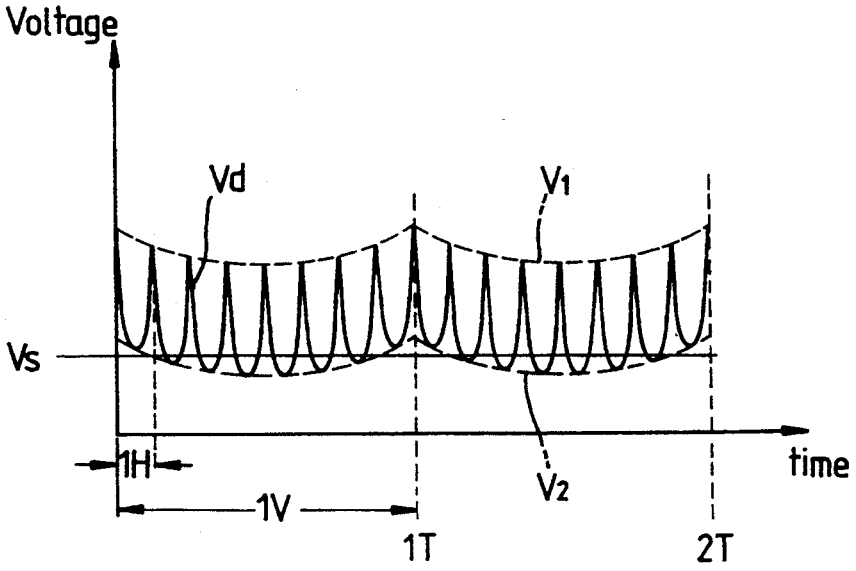
FIG.3(PRIOR ART)
FIG. 3 is a waveform diagram of another dynamic focus voltage applied to a conventional focus electron gun.
Figure 4:
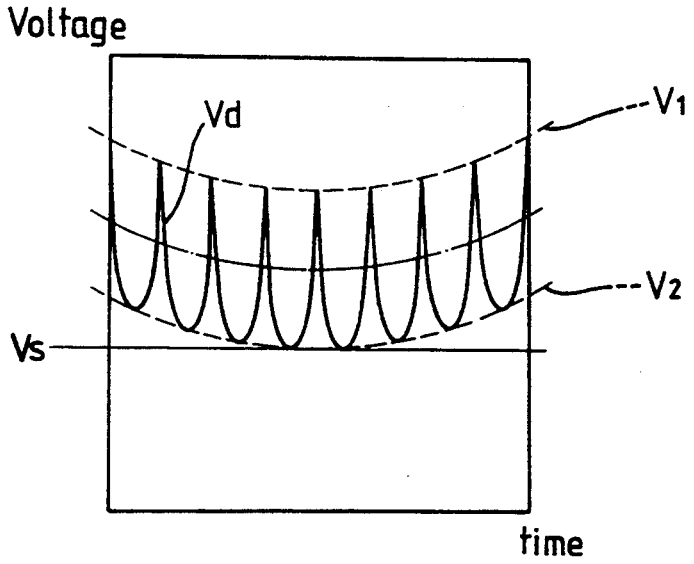
FIG.4 (PRIOR ART)
FIG. 4 is a waveform diagram of another dynamic focus voltage applied to a conventional focus electron gun.
Figures 5, 6:
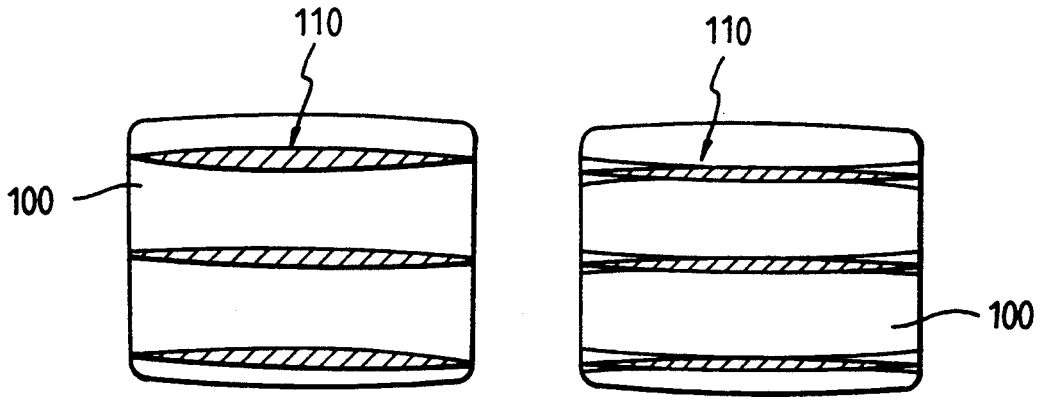
FIG.5 (PRIOR ART) FIG.6(PRIOR ART)
FIGS. 5 and 6 illustrate the distortion of scanning lines due to a conventional dynamic focus voltage applying method.
Figure 7:
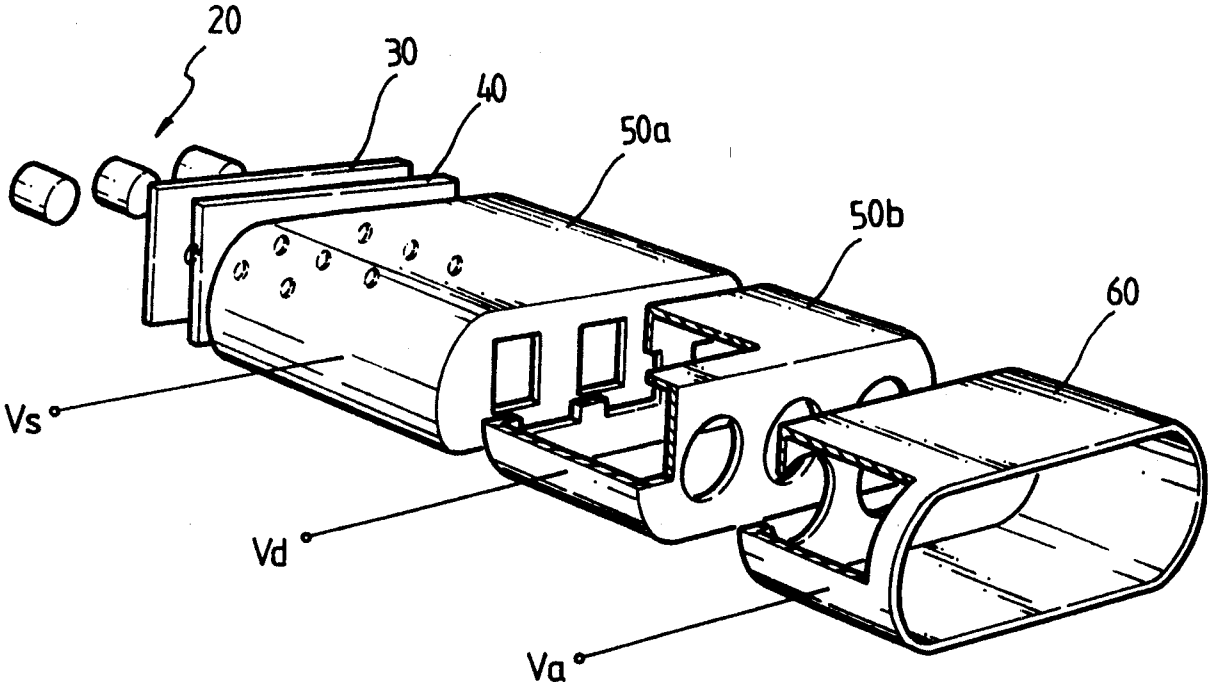
FIG. 7 is a schematic perspective view of a dynamic focus electron gun according to the present invention.

Referring to FIG. 7, dynamic focus electron gun 10 according to the present invention sequentially comprises a cathode 20 for emitting thermions, a control electrode 30 and screen electrode 40 for controlling the thermions to form an electron beam, a static focus electrode **50*a*, dynamic focus electrode 50*b* and final accelerating electrode 60 which form a prefocus lens and main focus lens of a major lens system for finally converging and accelerating the electron beam. Screen electrode 30, static focus electrode 50*a* and dynamic focus electrode 50*b* constitute a static prefocus lens and dynamic prefocus lens. Accelerating electrode 60 forms a dynamic main focus lens. Three vertically elongated electron beam passing holes are formed in line on the electron beam outgoing plane of static focus electrode 50*a* and three horizontally elongated electron beam passing holes are formed in line on the electron beam incoming plane of dynamic focus electrode 50*b*** which stands opposite to the outgoing plane of the static focus electrode. By doing this, a dynamic quadrupole lens is formed between the static focus electrode and dynamic focus electrode.

According to an ordinary method, 0 V is applied to control electrode 30 and 200–1200 V is applied to screen electrode 40. Static focus voltage Vs is applied to static focus electrode **50*a* and dynamic focus voltage Vd is applied to dynamic focus electrode 50*b*. An accelerating voltage Va of 20–35 Kv is applied to accelerating electrode 60**. Static focus voltage Vs is within the range of 20–35% of accelerating voltage Va. The peak voltage of the dynamic focus voltage is higher than the static focus voltage by 600–800 V.

Figure 8:
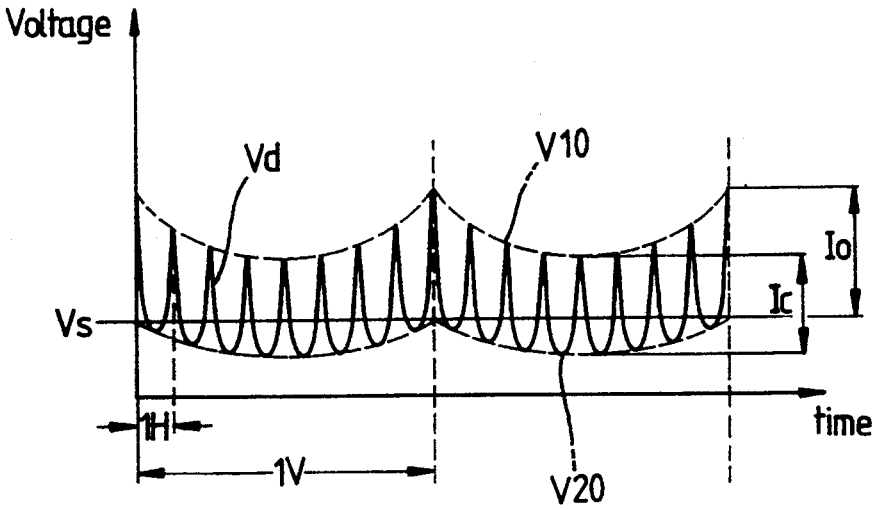
FIG. 8 is a waveform diagram of a dynamic focus voltage applied to the dynamic focus electron gun according to the present invention.
Figure 9:
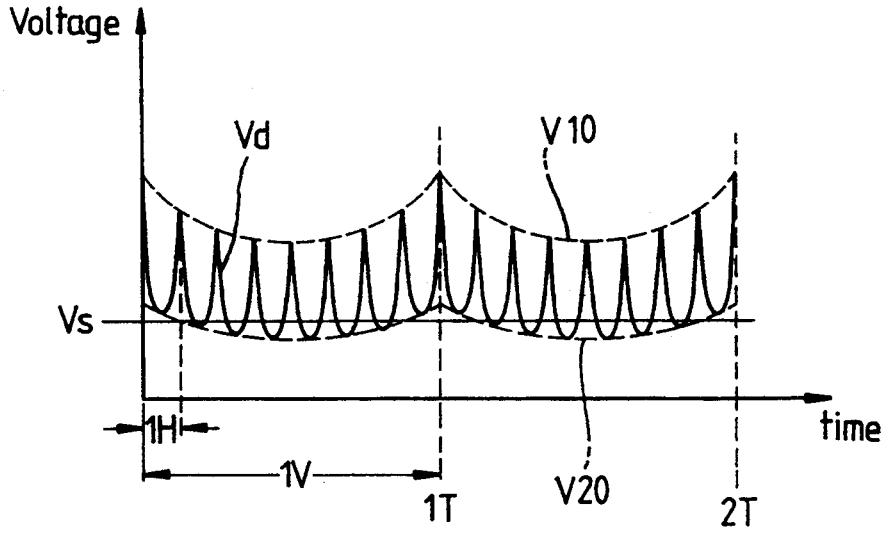
FIG. 9 is a waveform diagram of another dynamic focus voltage applied to the dynamic focus electron gun according to the present invention.
Figure 10:
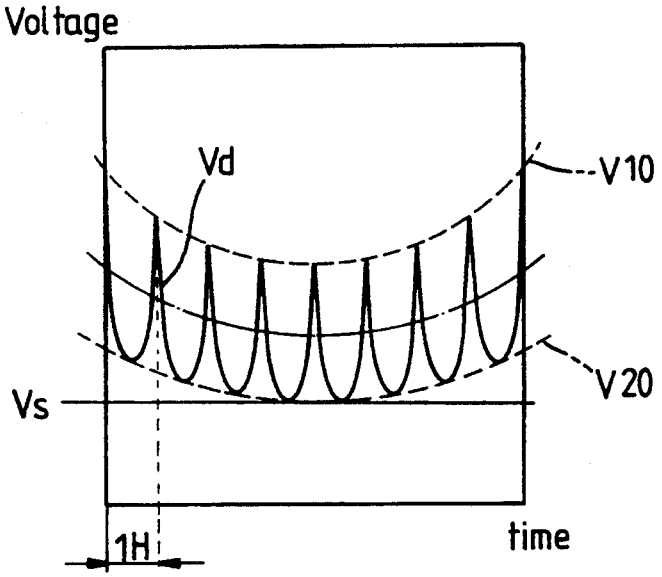
FIG. 10 is a waveform diagram of still another dynamic focus voltage applied to the dynamic focus electron gun according to the present invention.

The waveforms of the static and dynamic focus voltages applied to the dynamic focus electron gun of the present invention are generally shown as those of FIGS. 8, 9 and 10. In FIGS. 8, 9 and 10, static focus voltage Vs applied to static focus electrode **50*a* is maintained at a predetermined potential. Parabolic dynamic focus voltage Vd applied to dynamic focus electrode 50*b*** is varied according to portions of the screen where the electron beam arrives, and is repeated for every horizontal deflection period. As the feature of the present invention, the amplitude of each horizontal deflection period of the parabolic dynamic voltage is varied according to the landing positions of the electron beam, and the maximum and minimum of the dynamic focus voltage are varied for every vertical deflection period. The minimum voltage of each parabolic waveform of one horizontal deflection period has a value above, equal to or below the static focus voltage, and is relatively high when the electron beam lands on the upper and lower portions of each scanning line compared with when the beam lands on the center thereof. The difference of the minimum voltage is regularly varied by one vertical period by frames.

In FIGS. 8, 9 and 10, upper and lower wave-shaped lines V10 and V20, which are made by connecting the maximum points and minimum points of the parabolic waveforms, respectively, show the variation of the dynamic focus voltage when the electron beam lands on vertical lines passing the periphery and center of the screen. Since these are related to the vertical focus characteristics, they can be regarded as assumed first and second vertical dynamic focus voltages V10 and V20. With reference to the variation of the vertical voltages, it is noted that the difference of the dynamic focus voltage to the static focus voltage is varied in the overall (vertical and horizontal) direction of the screen. Further, according to the features of the present invention, the amplitude Io for one horizontal deflection period in the upper and lower portions of the screen and the amplitude Ic for one horizontal deflection period in the center of the screen are different. In the vertical deflection period of the vertical dynamic focus voltages V10 and V20, the variation rate on the left and right sides of the screen and the variation rate on the center of the screen are also different.

Referring to FIG. 9, when the electron beam lands on the center of the screen, the minimum of dynamic focus voltage Vd is lower than static focus voltage Vs, and when the electron beam lands on the periphery of the screen, the minimum of the dynamic focus voltage is relatively high.

Referring to FIG. 10, when the electron beam lands on the center of the screen, the minimum of dynamic focus voltage Vd is substantially equal to static focus voltage Vs. When the electron beam lands on the upper and lower portions of the screen, the minimum of the dynamic focus voltage is relatively high.

Here, the amplitude Io of the horizontal deflection period in the upper and lower portions of the screen and tile amplitude Ic of a horizontal deflection period in the center of the screen are different. In the vertical deflection period, the variation rate of the parabolic waveforms on the left and right sides of the screen is greater than that of the center of the screen. Accordingly, the variation rate of the assumed first vertical dynamic focus voltage V10 which connects the maximum points of the horizontal dynamic focus voltage and the variation rate of the assumed second vertical dynamic focus voltage V20 which connects the minimum points of the horizontal dynamic focus voltage are different.

As shown in FIG. 9, when the electron beam lands on the center of the screen, the minimum of the second vertical dynamic voltage V20 of dynamic focus voltage Vd is lower than the static focus voltage Vs, and in the tipper and lower portions of the screen, the maximum thereof is relatively high compared with the static focus voltage Vs. As shown in FIG. 10, when the electron beam lands on the center of the screen, the minimum of the second vertical dynamic voltage V20 of dynamic focus voltage Vd is substantially the same as the static focus voltage, and in the tipper and lower portions of the screen, the maximum thereof is relatively high.

As described above, the electron-gun of the present invention is characterized in that tile amplitude of the parabolic dynamic focus voltage is varied according to the scanning positions of the electron beam.

The operation and effect of the embodiments of the dynamic focus electron gun of the present invention will be described below.

Horizontal dynamic focus voltage Vd is varied according to the positions of the screen where the electron beam arrives, and is applied so that the amplitude of the horizontal deflection period 1 H in the upper and lower portions of the screen is greater than that in the center of the screen. The variation rates of vertical dynamic focus voltages V10 and V20 are greater in the left and right of the screen than in the center of the screen. In FIGS. 8, 9 and 10, each of the parabolas of the dynamic voltage illustrates horizontal focus voltage Vd and shows the variation of the horizontal focus voltage when the electron beam scans horizontally from the left or right to the right or left via the center of the screen.

Here, according to the feature of the present invention, the amplitude of the parabolic waveform of the horizontal dynamic focus voltage 20 in the upper and lower portions of the screen becomes greater than that in the center of the screen, thereby accomplishing a good focus characteristic in the upper and lower portions of the screen.

Specifically, when the electron beam projected from the electron gun scans the middle of each scanning line and the dynamic voltage slightly lower or higher than the static focus voltage is applied, the electron beam is influenced by the electric field between static focus electrode **50*a* and dynamic focus electrode 50*b* while passing through them. By doing this, beam spots in which the difference of the vertical and horizontal widths is relatively small are formed on the screen. When the dynamic focus voltage is the same as the static focus voltage, since a lens is not formed between static focus electrode 50*a* and dynamic focus electrode 50*b***, the electron beam passes through them without being influenced by the lens. By doing this, circular beam spots are formed in which the vertical and horizontal widths are almost the same.

When the electron beam scans the periphery of the scanning lines, since the dynamic focus voltage higher than the static focus voltage is applied, the electron beam is vertically elongated by being influenced by an intense quadrupole lens formed between static focus electrode **50*a* and dynamic focus electrode 50*b*** while passing them. The degree of the vertical elongation of the electron beam deflected toward the screen periphery is varied according to the scanning positions. When the electron beam scans the upper and lower portions of the screen, since a very intense quadrupole lens is formed, the electron beam projected toward the four corners of the screen is vertically elongated to the utmost and has an elongated focal length. As the vertically elongated electron beam is influenced by a non-uniform deflection magnetic field and due to the astigmatism according to the degree of asphericity of the screen, the electron beam forms an almost circular beam spot when reaching the screen periphery.

Figure 11:
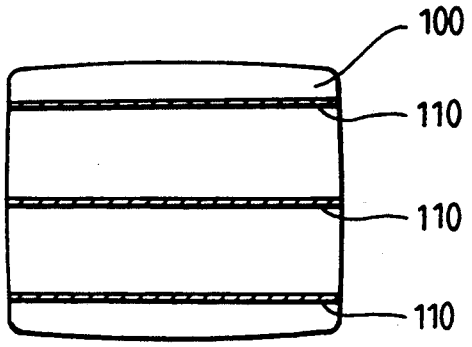
FIG. 11 shows scanning lines on the screen which are obtained by the dynamic focus electron gun according to the present invention.

Through the above process, as shown in FIG. 11, uniform scanning line 110 can be obtained throughout screen 100.

In the dynamic focus electron gun according to the present invention, as the dynamic focus voltage whose amplitude is varied according to the features of the present invention is applied, the horizontal focusing state and the vertical focusing degree can be adjusted.

Such a dynamic focus voltage applying method can be employed in a dynamic focus electron gun using a low voltage driving method in which a modulating potential is lower than a focusing potential, as well as in a dynamic focus electron gun using a high voltage driving method in which a modulating potential is higher than a focusing potential.

As described above, in the dynamic focus voltage applying method of the dynamic electron gun of the present invention, the horizontal dynamic focus voltage is varied according to the portions of the screen where the electron beam arrives, and is applied so that the amplitude of the horizontal deflection period in the tipper and lower portions of the screen is greater than that in the center of the screen. Since, in the vertical dynamic focus voltage, the variation rate of the vertical deflection period in the left and right of the screen is greater than that in the center of the screen, the focusing state is improved in the center and periphery of the screen to compensate for the deterioration of the focusing characteristic in the periphery of the screen due to the deflection yoke and its geometric structure and to accomplish a high-resolution picture throughout the screen.

The electron gun according to the present invention can be adapted in an HDTV as well as in ordinary televisions.

What is claimed is:

1. A dynamic focus electron gun comprising:

a cathode, a control electrode and a screen electrode which generate an electron beam, a static focus electrode having a static focus voltage, a dynamic focus electrode having a dynamic voltage including a first peak to peak amplitude and a second peak to peak amplitude and a final accelerating electrode having an accelerating anode voltage to form a main lens for accelerating and converging the electron beam;

wherein the first peak to peak amplitude of the dynamic focus voltage is greater than the second peak to peak amplitude of the dynamic focus voltage, the first and second amplitudes corresponding to respective scanning positions of the electron beam, and wherein when the electron beam lands on the center of the screen, the negative peak voltage of one horizontal deflection period of said dynamic focus voltage is lower than said static focus voltage, and when the electron beam lands on the upper and lower portions of the screen, the negative peak voltage is greater than the static focus voltage.

2. A method of driving a dynamic focus electron gun comprising the steps of:

applying a static voltage to a static focus electrode;

applying a dynamic focus voltage to a dynamic focus electrode;

applying an accelerating anode voltage to a final accelerating electrode; and varying the dynamic focus voltage according to the point of arrival on a screen of an electron beam produced by the electron gun so that the peak to peak amplitude of the dynamic focus voltage when the electron beam scans the upper and lower portions of the screen is greater than the peak to peak amplitude of the dynamic focus voltage when the electron beam scans the center of the screen, and adjusting the dynamic focus voltage when the electron beam scans the center of the screen so that the negative peak over one horizontal deflection period of the dynamic focus voltage is lower than the static focus voltage.

* * * * *